US005735597A

United States Patent [19]

Weng

[11] Patent Number: 5,735,597

[45] Date of Patent: Apr. 7, 1998

[54] DECORATIVE LAMP STRUCTURE

[76] Inventor: Ting-Hung Weng, P.O. Box 96-405, Taipei 10098, China

[21] Appl. No.: 739,459

[22] Filed: Oct. 29, 1996

[51] Int. Cl.[6] ..... F21V 27/00

[52] U.S. Cl. ..... 362/267; 362/249; 362/806

[58] Field of Search ..... 362/226, 249, 362/252, 806, 267; 439/271, 277, 280

[56] References Cited

U.S. PATENT DOCUMENTS 4,679,126 7/1987 Van Sickler ..... 362/226

FOREIGN PATENT DOCUMENTS 1085937 10/1967 United Kingdom ..... 362/806

*Primary Examiner*—Y. My Quach
*Attorney, Agent, or Firm*—Bacon & Thomas

[57] ABSTRACT

An improved decorative lamp structure, which comprises an outer socket and a connecting sleeve; the outer socket has a socket opening for receiving the connecting sleeve; the lower part of the socket opening is provided with two copper plate channels for mounting two copper plates connected with two power wires respectively; under the copper plate channels, two symmetrical semi-circular slots are furnished on both sides of the guide hole for power wires; the guide hole is used for laying the power wires attached with two copper plates respectively. The two copper plates are to be plugged into the two copper plate channels respectively; the guide hole between the two power wires is to be plugged in with a fixing member having two symmetrical semi-circular slots before the connecting sleeve being plugged in place. The outer surface of the fixing member and the taper surface of the guide hole for power wires are joined together closely so as to prevent rain water from infiltrating into the guide hole.

3 Claims, 3 Drawing Sheets

DECORATIVE LAMP STRUCTURE

BACKGROUND OF THE INVENTION

1. Field of the Invention

This invention relates to a decorative lamp, and particularly to a decorative lamp, having power wires fastened in place and provide a waterproof structure.

2. Description of the Prior Art

In the conventional decorative lamp string for Christmas, the two power wires of the small bulb are laid through the opening part of the bulb sleeve socket, and are bent against two side walls in the bulb sleeve socket; the bulb sleeve socket is then plugged into a socket, in which two ends of two power wires are connected with two copper plates respectively; the two copper plates are fastened to grooves in the socket respectively. When a small bulb is plugged in the socket, the two bent power wires will be in close contact with the two copper plates respectively; a given number of sockets are connected in series to form into a string of decorative lamps for Christmas.

Each of the sockets has an open end, from which the power wires are plugged in. Between the two power wires, there is a guide groove, which is subject to infiltrating water in case of rain; as a result, the infiltrated water will cause an electric shock to a person who touches the same.

SUMMARY OF THE INVENTION

The prime object of the present invention is to provide an improved decorative lamp structure, which comprises an outer socket and a connecting sleeve; the outer socket has a socket opening for receiving the connecting sleeve; the lower part of the socket opening is provided with two copper plate channels for mounting two copper plates connected with two power wires respectively; under the copper plate channels, two symmetrical semi-circular slots are provided furnished on both sides of the guide hole for power wires; the guide hole is used for laying the power wires attached with two copper plates respectively. The two copper plates are to be plugged into the two copper plate channels respectively; the guide hole between the two power wires is to be plugged in with a fixing member having two symmetrical semi-circular slots before the connecting sleeve is plugged in place. The outer surface of the fixing member and the taper surface of the guide hole for power wires are closely joined together, closely to prevent rain water from infiltrating into the guide hole.

Another object of the present invention is to provide an improved decorative lamp structure, in which the bottom of the bulb socket in the connecting sleeve is provided with an isolating plate between the two filament guide slots. The lower end of the isolating plate extends into a salient block, of which both sides are furnished with two small slots respectively. The two small slots are in communication with the filament guide slots respectively so as to pulling the filaments downwards to the two outer surfaces. After the connecting sleeve is plugged into the outer socket, the salient block on the connecting sleeve will be plugged into the square hole of the fixing member so as to isolate the two filaments.

Still another object of the present invention is to provide an improved decorative lamp structure, in which the outer socket has a bevel surface to be mated with an O-shaped groove on the connecting sleeve; after the connecting sleeve is plugged into the outer socket, the connecting sleeve and the outer socket will be connected together closely and tightly.

A further object of the present invention is to provide an improved decorative lamp structure, in which the bulb socket in the connecting sleeve is plugged with a bulb closely and directly by means of the elasticity of a plastic material thereof, i.e., the bulb can be hermetically pressed into the bulb socket.

DETAILED DESCRIPTION OF THE PREFERRED EMBODIMENT

Figure 1:
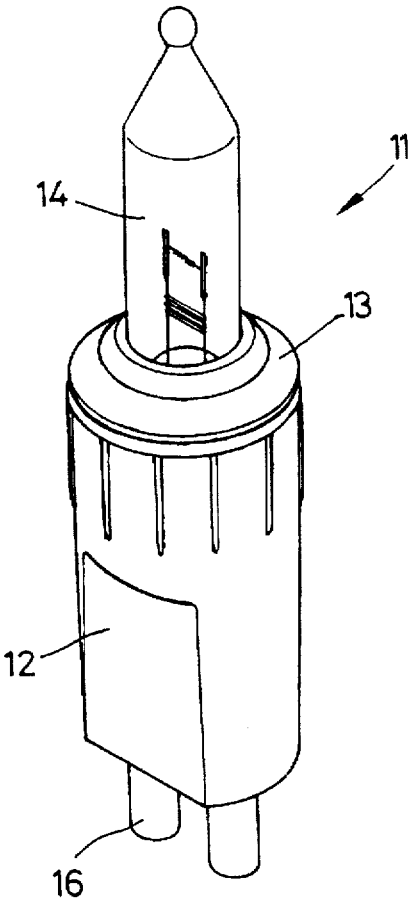
FIG. 1 is a perspective view of an embodiment according to the present invention.
Figure 2:
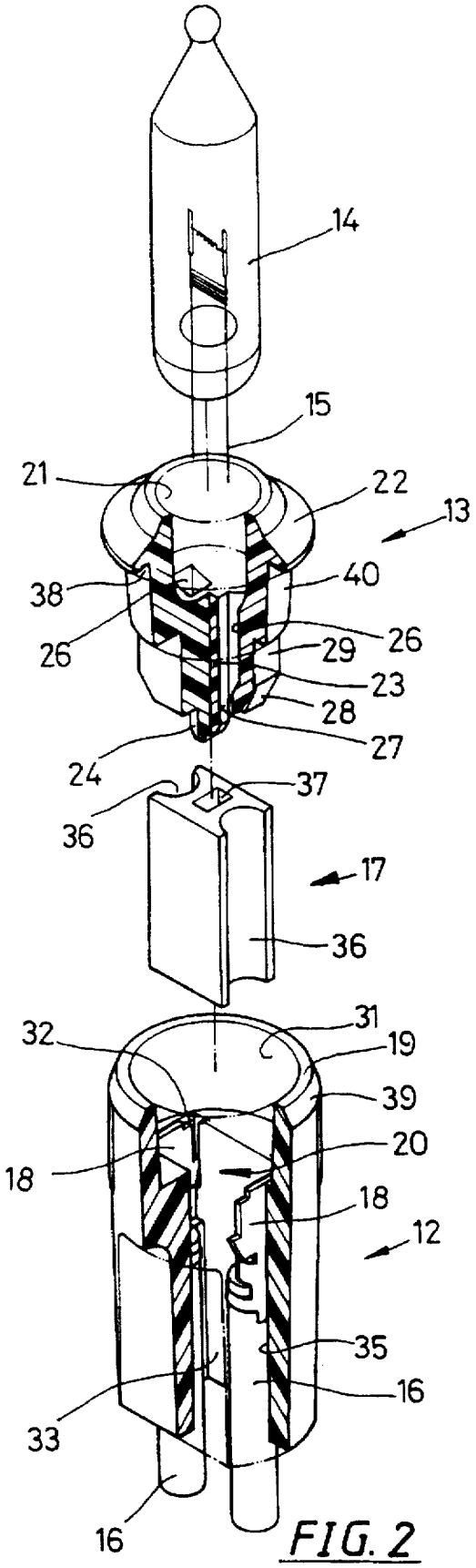
FIG. 2 is an exploded perspective view of the present invention, showing the outer shape and relation among parts thereof.
Figure 4:
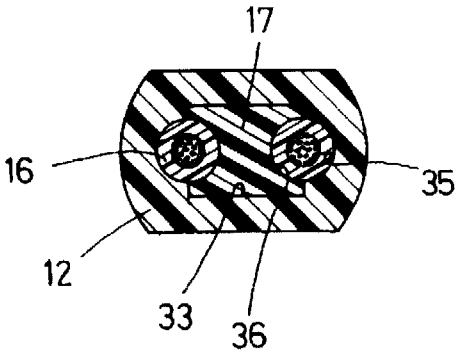
FIG. 4 is a sectional view of the present invention, showing a section view taken along line 4—4 in FIG. 3.
Figure 3:
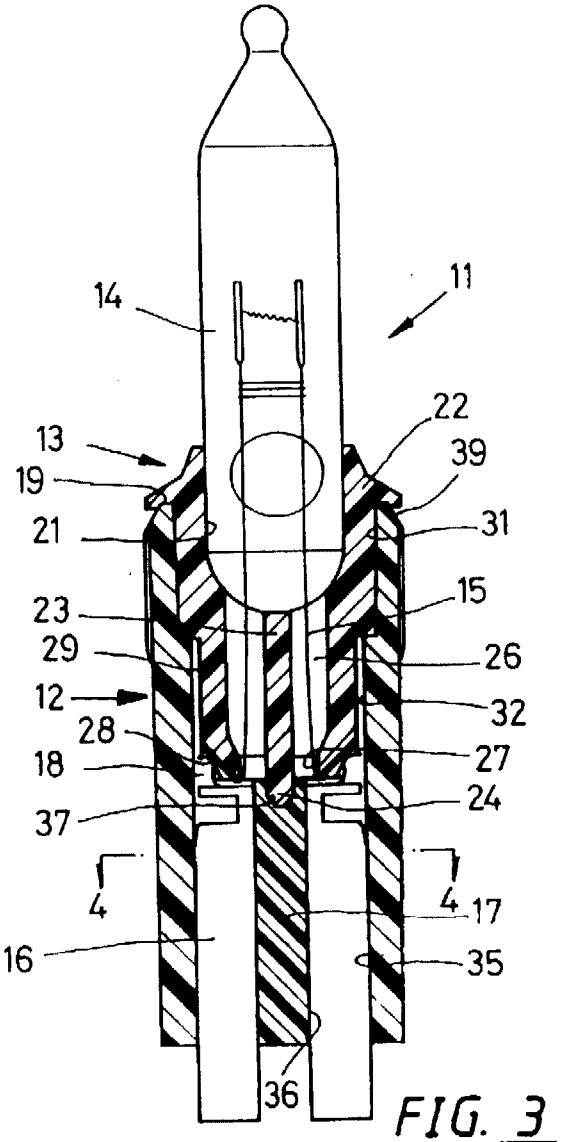
FIG. 3 is a sectional view of the present invention, showing the assembled relation among parts thereof.
Figure 6:
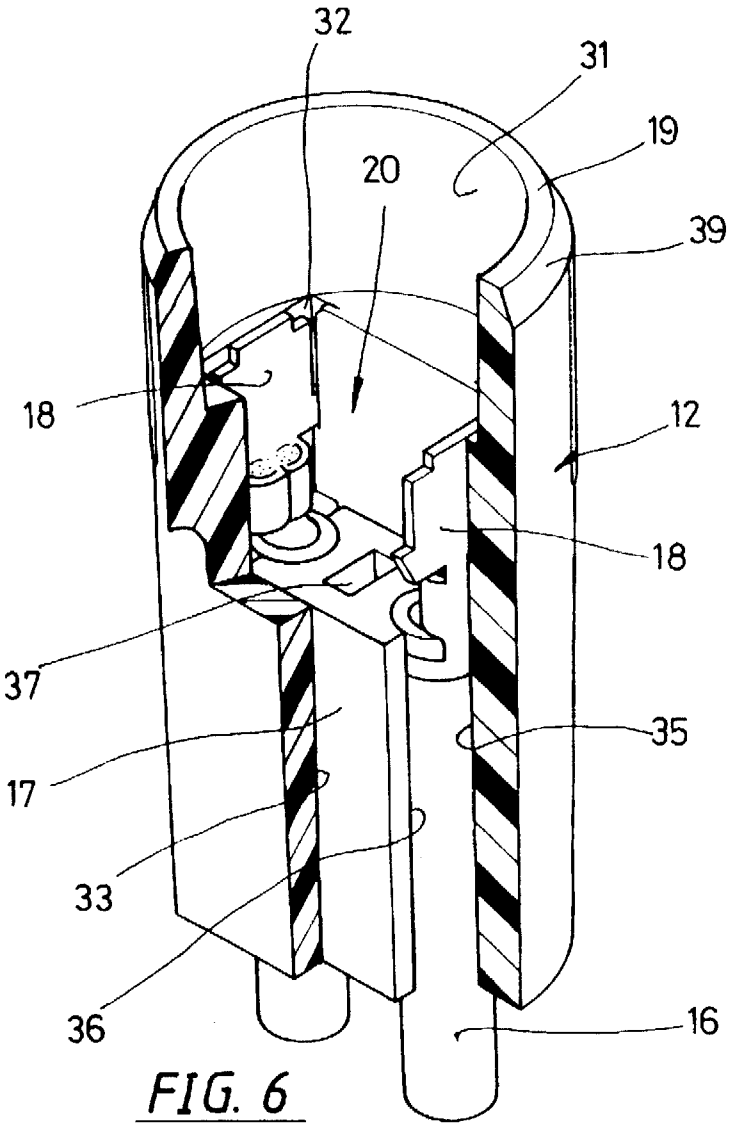
FIG. 6 is a fragmental section view, showing the assembled relation between the outer socket and the fixing member thereof.
Figure 5:
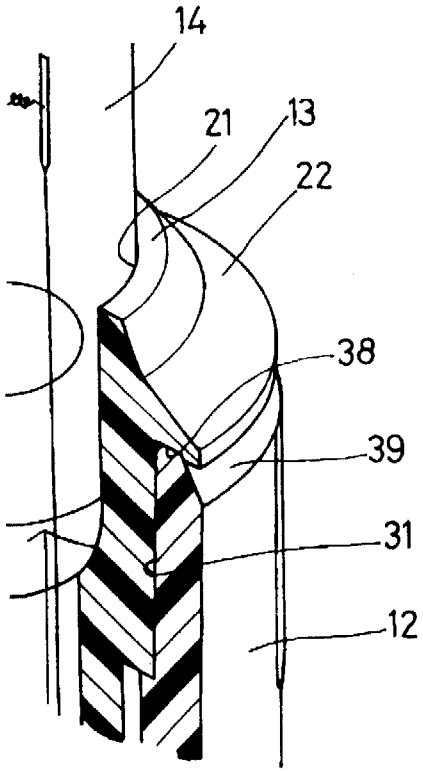
FIG. 5 is a partial sectional view, showing the assembled relation between the connecting sleeve and the bulb thereof.

Referring to FIGS. 1 to 3, the decorative lamp 11 according to the present invention comprises an outer socket 12, a connecting sleeve 13, a bulb 14, power wires 16, a fixing member 17 and copper plates 18. The outer socket 12 has a socket opening 31 inside the end surface 19; inside the socket opening 31, there is a positioning channel 20. The socket opening 31 and the positioning channel 20 are used for plugging in with a connecting sleeve 13. Both sides of the positioning channel 20 are furnished with two copper plate channels 32 respectively for receiving two copper plates 18 respectively mounted on ends of the two power wires 16; the power wires 16 are laid through guide hole 33 in the outer socket 12, and extended outside. Within the guide hole 33 for the two power wires 16, there is a fixing member 17. Both the guide hole 33 and the fixing member 17 are provided with opposite semi-circular slots 35 and 36 respectively. The fixing member 17 is to be plugged in place from the socket opening 31, and is mounted in place by means of the taper surfaces between the outer surface of the fixing member 17 and the surface of the guide hole 33 for the power wires. The connecting sleeve 13 is plugged into the socket opening 31 of the outer socket 12, and is mounted in place by means of the close contact between the end surface 19 and the connecting sleeve 13; then, the bulb 14 and the connecting sleeve 13 are also closely connected together so as to prevent water from entering the outer socket 12, and to minimize electric shock.

Referring to FIGS. 2, 3, 4 and 6, the outer edge of the end surface 19 on the outer socket 12 is furnished with a bevel surface 39; the inside of the end surface has a socket opening 31 with a suitable depth for receiving the cylinder 40 of the connecting sleeve 13. The bottom of the socket opening 31 has a rectangular positioning channel 20, of which both sides are furnished with copper plate channels 32 respectively to facilitate two copper plates 18 on the two power wires 16 to plug in. The power wires 16 extend outside through the guide hole 33. The lower part of the positioning channel 20 is furnished with a rectangular surface, of which both sides are provided with two semi-circular slots 35 respectively for laying power wires 16. The fixing member 17 is plugged into the guide hole 33 between the two power wires 16 to clamp the power wires 16 in place and to prevent water from entering the guide hole 33.

The fixing member 17 plugged in the guide hole 33 of power wires is substantially a rectangular member, of which both sides are provided with two semi-circular slot 36 for receiving power wires 16 respectively; the outer surface thereof is furnished with a suitable taper surface. The guide hole 33 of the power wires is also furnished with the similar taper surface. After the fixing member 17 is plugged into the socket opening 31 of the outer socket 12, and pushed in place, the end of the fixing member 17 will extend to the opening of the guide hole 33 for power wires. The fixing member 17 and the guide hole 33 will be in close contact; the two power wires 16 between the fixing member 17 and the guide hole 33 are clamped in place; then, the copper plates 18 are plugged in the copper plate channels 32 will also fastened in place.

The socket opening 31 in the end surface 19 of the outer socket 12 is used for plugging a connecting sleeve 13 therein; in order to prevent rain water from infiltrating into the end surface 19 and the outer edge of the connecting sleeve 13, the outer edge of the end surface 19 of the outer socket 12 is furnished with a bevel surface 39. The connecting sleeve 13 plugged in the socket opening 31 has an end surface 19 to be mated with an O-shaped groove 38 under the outer bevel surface 22 of the connecting sleeve 13, and such mating connection can prevent rain water from infiltrating therein.

The upper edge of the connecting sleeve 13 is furnished with an outer bevel surface 22, and a bulb socket 21 for mounting a bulb 14; the bottom of the bulb socket 21 has a semi-spherical shape and is provided with two separate filament guide slots 26, each having a small slot 27; the outer edge of the small slot 27 has a bevel surface 28; the two filaments 15 of the bulb 14 pass through the two separate filament guide slots 26, and the two small slots 27, and then extend to the bevel surface 28 and the outer surface 29; an isolating plate 23 is furnished between the two separate filament guide slots 26 in the connecting sleeve 13; the isolating plate 23 has a salient block 24 under and between the two small slots 27. The isolating plate 23 and the salient block 24 are used for separating the two filaments from each other to prevent them from having short circuit. After the connecting sleeve 13 is plugged into the socket opening 31 of the outer socket 12, the salient block 24 will be fitted in the square hole 37 on the top of the fixing member 17. The two separate filaments 15 are pulled straight on the outer surface 29 under the connecting sleeve 13. After the connecting sleeve 13 is plugged into the socket opening 31 of the outer socket 12, the two copper plates 18 on both sides of the positioning channels 20 and the filaments 15 of the bulb 14 will be in contact for receiving power.

The bulb socket 21 in the center of the outer bevel surface 22 of the connecting sleeve 13 is used for receiving a bulb 14 with two filaments 15; in order to have a better hermetic contact between the bulb 14 and the bulb socket 21, the diameter of the bulb socket 21 should be equal to or slightly less than that of the bulb 14. The opening part of the bulb socket 21 is provided with a small guide horn, and the connecting sleeve 13 is made of an elastic plastic material. After the bulb 14 is plugged into the bulb socket 21 of the connecting sleeve 13, the bulb 14 and the bulb socket 21 are fitted together tightly. After the connecting sleeve 13 is plugged into the socket opening 31 of the outer socket 12, the packing force of the socket opening 31 can prevent the bulb 14 from rotating so as to avoid a short circuit.

According to the present invention, the bulb 14 and the bulb socket 21 of the connecting sleeve 13 are fitted together tightly by means of the elastic plastic material; the connecting sleeve 13 and the outer socket 12 are also fitted together tightly by means of the end surface 19 of the outer socket 12 and the O-shaped groove 38 of the connecting sleeve 13. On one end of the outer socket 12, power wires 16 are plugged in; the fixing member 17 having semi-circular slots 36 and a taper surface will be plugged into the socket opening 31 of the outer socket 12 so as to fasten the two power wires 16 in place. Since the entering part of the power wires 16 has a better hermetic seal, no water can infiltrate therein to cause a short circuit.

I claim:

1. A decorative lamp structure comprising an outer socket having a rectangular positioning channel therein, a connecting sleeve having a bulb socket with two small slots, two outer surfaces and two bevel surfaces, a bulb having two separate filaments, a rectangular fixing member having a suitable taper outer surface, two power wires and two copper plates; said bulb plugged into said bulb socket of said connecting sleeve; said separate filaments of said bulb being pulled out through two filament guide slots in a bottom of the bulb socket and said two small slots and being laid on said two outer surfaces through said two bevel surfaces respectively; a socket opening in said outer socket plugged with said connecting sleeve; an end surface of one end of said outer socket being provided with a bevel surface; both sides of said rectangular positioning channel being provided with two copper plate channels, respectively, formed in the outer socket for receiving said two copper plates on said two power wires, respectively, so as to mount said copper plates in place; a bottom of said positioning channel provided with a wire guide hole having two semi-circular slots formed in said outer socket respectively; both sides of the fixing member provided with two semi-circular slots; said two copper plates plugged into said two copper plate channels, said two power wires being positioned in said two semi-circular slots, respectively, of said guide hole, after said fixing member pushing and inserting into said bottom of said positioning channel of said outer socket, said two semi-circular slots of said fixing member being in close contact with outer surfaces of said power wires, respectively, with said fixing member in close and tight contact with said guide hole, and said power wires fastened in said semi-circular slots of said fixing member and said semi-circular slots of said guide hole without having rain water infiltrated into said outer socket.

2. A decorative lamp structure as claimed in claim 1, wherein said connecting sleeve includes an O-shaped groove mated with said end surface of said outer socket so that the O-shaped groove and the end surface of said outer socket are tightly and closely joined together.

3. A decorative lamp structure as claimed in claim 1, wherein a top of said fixing member includes a square hole, a bottom of said bulb socket having an isolating plate dividing said small slots, and said isolating plate extending outwardly into a salient block plugged into said square hole in said fixing member.

* * * * *